US008631748B2

(12) United States Patent
Tavares de Pinho

(10) Patent No.: US 8,631,748 B2
(45) Date of Patent: Jan. 21, 2014

(54) INTRA-CASSETTE SECURITY DEVICE FOR BANKING EQUIPMENT

(71) Applicant: Tecnologia Bancaria S.A, Barueri (ES)

(72) Inventor: Nelson Tavares de Pinho, São Paulo (BR)

(73) Assignee: Tecnologia Bancaria S.A. (BR)

( * ) Notice: Subject to any disclaimer, the term of this patent is extended or adjusted under 35 U.S.C. 154(b) by 0 days.

(21) Appl. No.: 13/688,676

(22) Filed: Nov. 29, 2012

(65) Prior Publication Data

US 2013/0160682 A1 Jun. 27, 2013

(30) Foreign Application Priority Data

Dec. 19, 2011 (BR) ..... 1105321

(51) Int. Cl.
*E05G 1/00* (2006.01)

(52) U.S. Cl.
USPC ..... 109/20; 109/25; 109/27; 109/28; 109/33

(58) Field of Classification Search
USPC ..... 109/20, 25–44, 58.5
See application file for complete search history.

(56) References Cited

U.S. PATENT DOCUMENTS

| | | | | |
|---|---|---|---|---|
| 5,775,235 | A * | 7/1998 | Lindskog et al. | 109/25 |
| 6,259,366 | B1 * | 7/2001 | Lindskog et al. | 340/568.7 |
| 6,536,348 | B1 * | 3/2003 | Gral | 102/293 |
| 6,564,726 | B1 * | 5/2003 | Lindskog | 109/25 |
| 6,712,011 | B2 * | 3/2004 | Fumanelli | 109/20 |
| 7,201,312 | B2 * | 4/2007 | Fumanelli | 235/379 |
| 2001/0000384 | A1 * | 4/2001 | Appeltans et al. | 109/36 |
| 2002/0029728 | A1 * | 3/2002 | Walker | 109/25 |
| 2003/0033965 | A1 * | 2/2003 | Van Lint | 109/29 |
| 2004/0154500 | A1 * | 8/2004 | Richard et al. | 109/25 |
| 2005/0139132 | A1 * | 6/2005 | Linkskog | 109/37 |
| 2006/0230994 | A1 * | 10/2006 | Besnard | 109/25 |
| 2009/0235847 | A1 * | 9/2009 | Villiger | 109/25 |

* cited by examiner

*Primary Examiner* — Lloyd Gall
(74) *Attorney, Agent, or Firm* — Cantor Colburn LLP

(57) ABSTRACT

A banking equipment intra-cassette security device (1) being assembled under the lid (T) of a cassette (C) storing money bills (A). The device (1) includes a main block (2) equipped with cavities (3) filled with pyrotechnical material (5), which can be ignited by a wick (9) which is activated by a metallic filament (11) electrically powered by the cassette (C) circuit.

3 Claims, 4 Drawing Sheets

INTRA-CASSETTE SECURITY DEVICE FOR BANKING EQUIPMENT

FIELD OF THE INVENTION

The present descriptive report refers to a patent application proposing an intra-cassette security device to be employed in banking equipment of ATM (Automated Teller Machine) type, as well as in money supplying banking equipment, also known as "Cash Dispensers", to be mounted over each one of the cassettes used to store the paper money bills in the above referred equipment, in order to incinerate the bills contained in such cassettes, if the banking equipment is subjected to a violation attempt.

BACKGROUND OF THE INVENTION

The present state of the art contemplates a condition where the banking institutions, for long time now, have provided a series of fixtures to their clients, including among it the ATMs, which are self-servicing external facilities, where several types of operations can be performed, with money draft being one of the most important services available.

Recently, criminality has manifested special interest in self-servicing equipment, which are being the target of attacks, which sometimes are perpetrated with the use of explosives, intended to destroy the equipment's structure, opening, therefore, the way for accessing the cassettes storing the bills.

A solution that has been used provides the equipment of such cassettes with devices which, in case of explosion, will break ink-containing devices, which, in turn, will irremediably stain the bills, in order to mark them.

In such context, it's being proposed a security device which operates in an innovative way, and which is not based in the use of dying substances to mark the money bills, with the device described herein being based in the partial destruction of the bills, by incineration.

BRIEF SUMMARY OF THE INVENTION

The device disclosed herein intends to represent an alternative to the conventional devices employed today, specially in respect to dye-operating devices.

The device which is the subject of the present patent application is basically composed by a block, which is mounted in the internal face of the cassette's lid, such block counting with a plurality of chambers, filled with a pyrotechnical material.

The referred pyrotechnical material is pressed into the chambers, each one of such chambers presenting an opening through which the contact with the pyrotechnical material itself is made, via a wick.

The wick runs along the chamber openings alignment, being connected, by one of its sides, to a metallic filament (nickel-chrome) which glows when powered by the electric energy proceeding from the electric circuit to which the cassette is connected.

Therefore, an actuation device based in an explosion-sensitive glass component, which when broken in case of violation, closes the electric circuit supplying the metallic filament, which glows when heated promoting the deflagration of the pyrotechnical material stored inside the chambers attached to the main block of the security device.

BRIEF DESCRIPTION OF THE DRAWINGS

The present security device will be described in details, regarding to the drawings listed below, where.

DETAILED DESCRIPTION OF THE INVENTION

Figure 1:
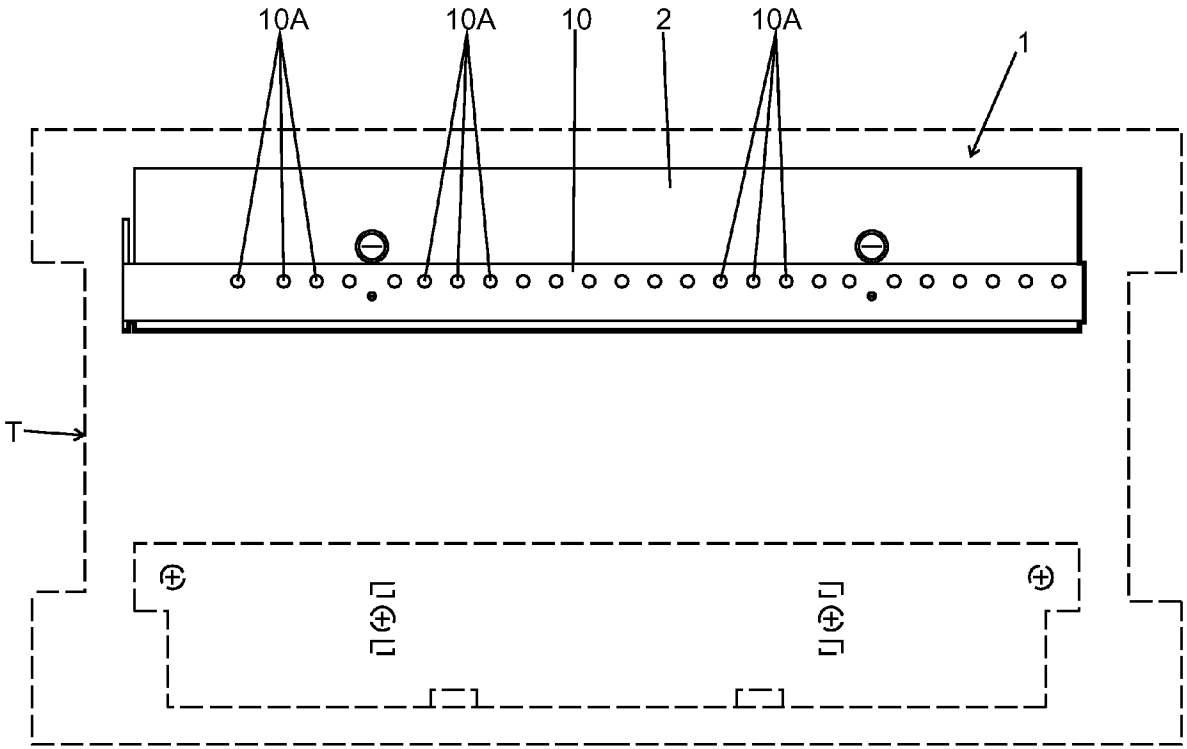
FIG. 1 is a plan view of the internal face of the lid of a cassette used to store money bills in banking equipment.
Figure 2:
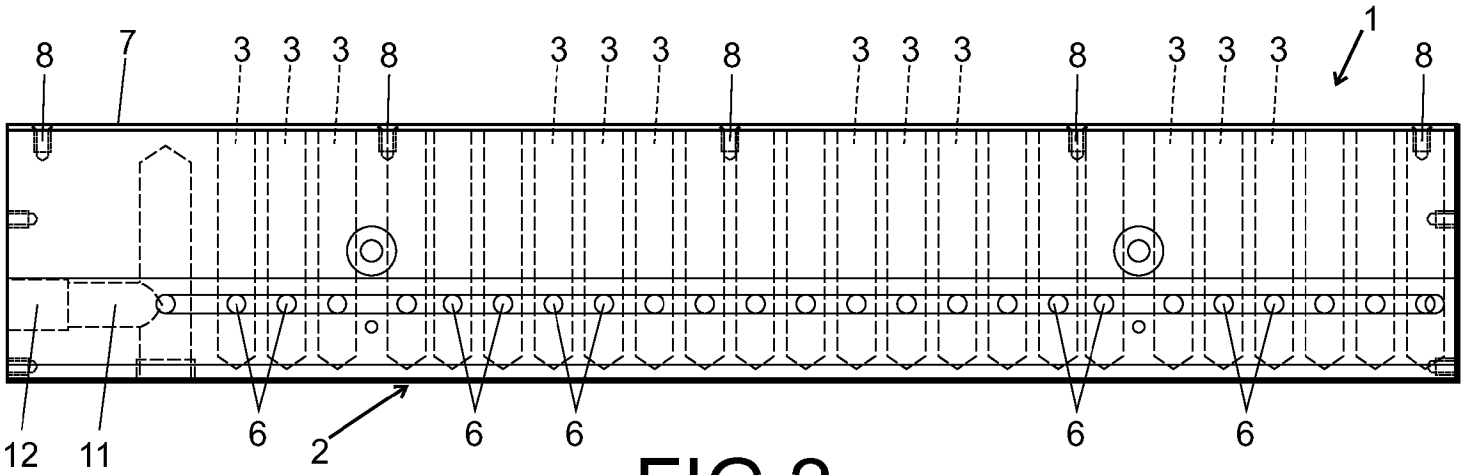
FIG. 2 is a separate view of the security device disclosed herein.
Figure 3:
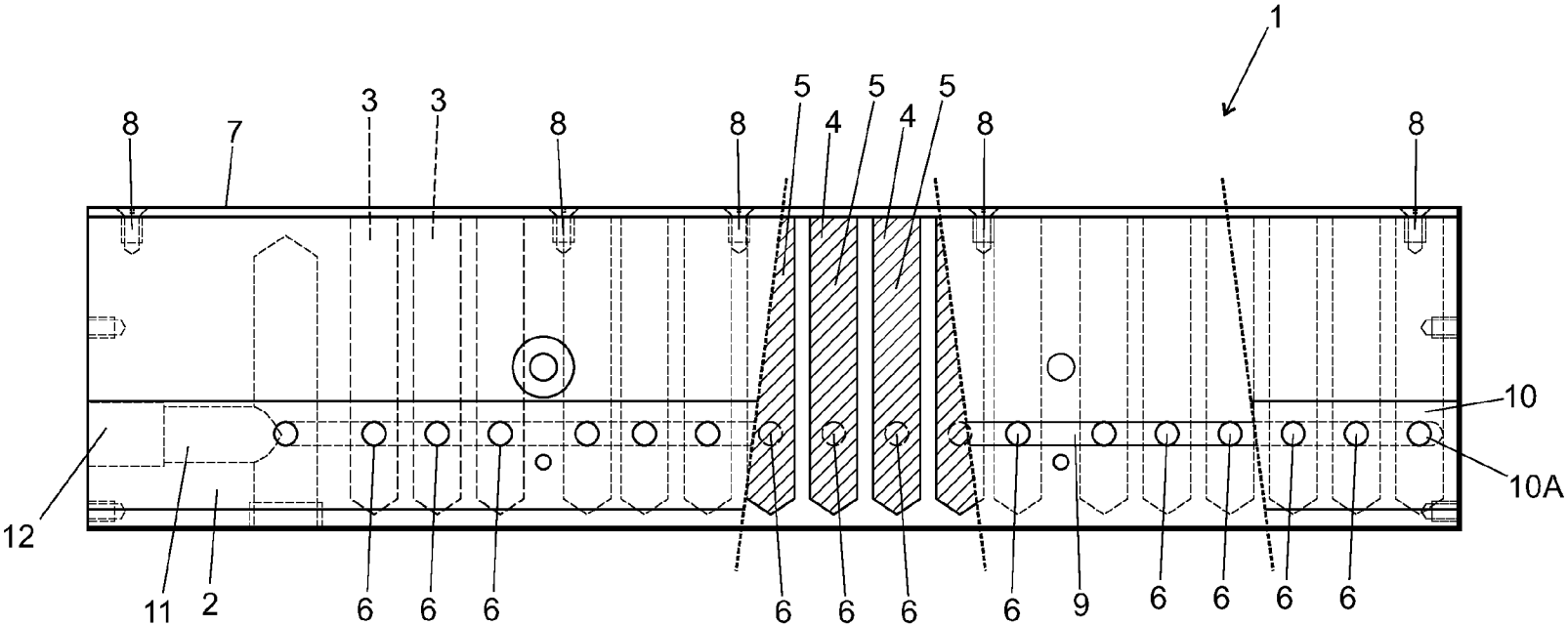
FIG. 3 is a partially cut view of the security device separately taken.
Figure 4:
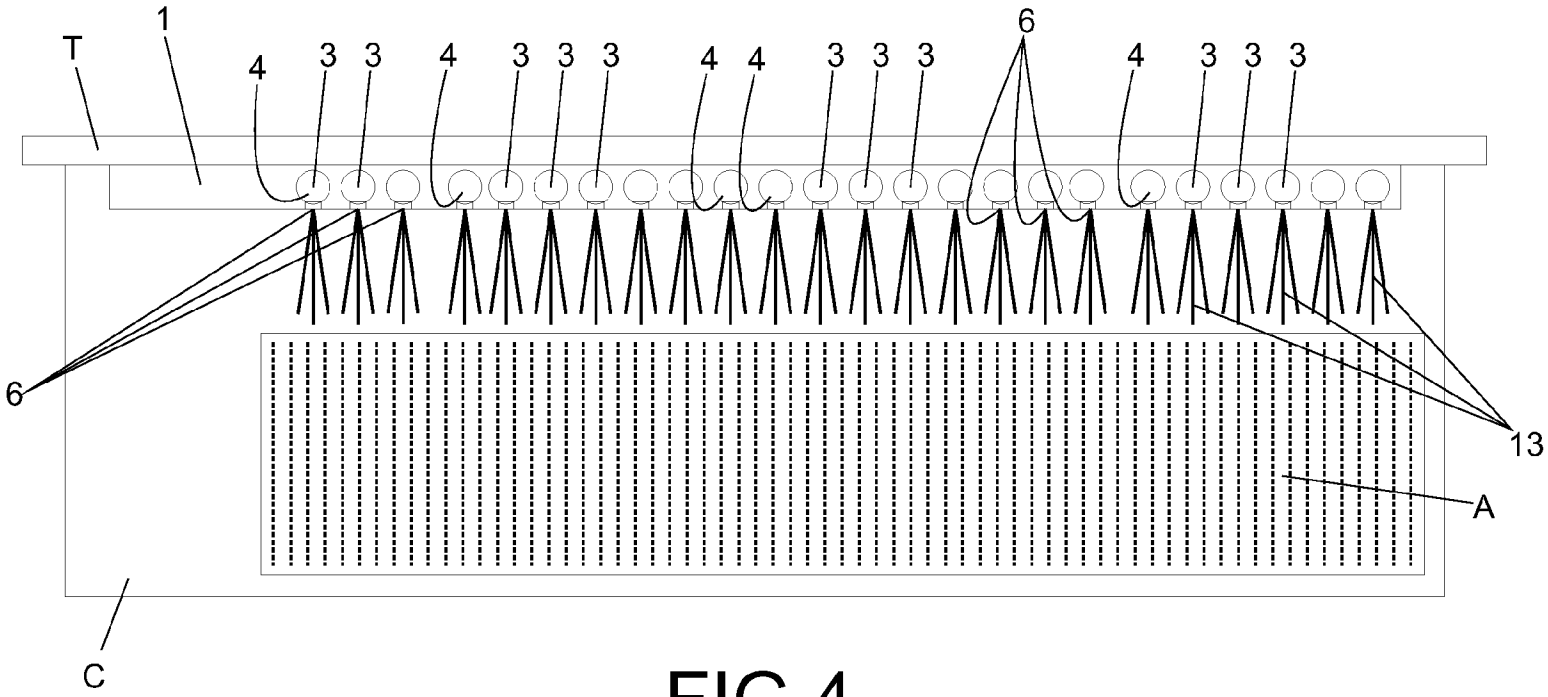
FIG. 4 shows the schematically action of the present device inside a money bill storage cassette, where it can be seen that the flames produced by the referred device are directed towards the money bills, causing, therefore, partial incineration of such bills.

In accordance to what is shown by the figures listed above, the intra-cassette security device for banking equipment, which is the subject of the present patent application, and which is indicated in general by numeric reference 1, is defined by a main block 2—produced in aluminum or plastic—providing a series of cavities 3 distributed side by side, where each cavity counts with an incoming opening 4, through which a given volume of pyrotechnical material 5 is pressed, until filling the whole volume of said cavity.

Each cavity 3 also counts with a final opening 6 integrating the general alignment of the plurality of final openings 6 of the set of cavities 3 incorporated to the main block 2.

The face of the main block 2 from which the incoming openings 3 emerge is closed by a plate 7, fastened by bolts 8 to the main block.

Along the general alignment of the plurality of final openings 6 of the main block, a wick filament 9 is assembled, being kept in its correct position by a plate 10 equipped with holes 10A which are jig-aligned with the main block openings 6.

The wick 9 is connected to a metallic filament 11 (nickel-chrome) which is electrically powered by the cassette's circuit, such filament 11 can be actuated through a button or a breaking device (glass) 12.

The systematic of use of the device 1 proposed herein provides its assembling under the lid T of a cassette C, remaining, for such reason, facing the inside of the referred cassette where the money bills A are stored.

In case of banking equipment violation (not shown), the filament 11 is electrically powered and glows, causing the wick 9 to burn, which, in turn, communicates its burning condition to the respective opening 6 of each cavity 3, thus provoking the ignition of the pyrotechnical material 5 contained in each cavity 3.

The pyrotechnical material 5, when igniting, promotes the generation of flame jets 13 approximately 40 millimeter long, which are projected away from the openings and disposed towards the money bills A.

The volume of pyrotechnical material 5 contained in the cavities 3 is sized-up in order to produce a flame flow enabled to last approximately 10 seconds, that is more than enough time to incinerate the money bills A, marking it and evidencing that they are product of a banking equipment violation.

The security device disclosed herein renders the money bills unusable, thus making the banking equipment violation unproductive.

The invention claimed is:

1. A banking equipment intra-cassette security device, of the type destined to equip cassettes (C) for money bills (A) storage, and which integrate self-servicing banking equipment, the security device comprising a main block, (2), providing a series of cavities distributed side by side (3), where each cavity includes an incoming opening (4), through which a given volume of pyrotechnical material (5) is pressed, until filling the whole volume of said cavity; each cavity (3) further includes a final opening (6) wherein the final openings (6) of the set of cavities (3) are aligned and incorporated to the main block (2); a face of the main block (2) from which the incoming openings (4) emerge is closed by a plate (7), fastened by bolts (8) to the main block; along the general alignment of the final openings (6) of the main block, a wick (9) filament is assembled, being kept in its correct position by a plate (10) equipped with holes (10A) which are aligned with the final openings of the main block (2); the wick (9) is connected to a metallic filament (11) which is electrically powered by circuit of the cassette (C), such filament (11) can be actuated through a button or a breaking device (12).

2. The banking equipment intra-cassette security device according to claim 1, wherein the security device (1) is mounted under a lid (T) of a cassette (C), facing the inside of the cassette (C) where the money bills (A) are stored.

3. The banking equipment intra-cassette security device according to claim 1, wherein upon tampering, the filament (11) is electrically powered and glows, the wick (9) burns, and ignites the pyrotechnical material (5) contained in each cavity (3) through each respective opening (6) of each cavity (3), wherein a plurality of flame jets (13) approximately 40 mm long are projected away from the openings and towards the money bills (A).

* * * * *